United States Patent [19]

Hauser, Jr.

[11] 4,386,893

[45] Jun. 7, 1983

[54] GEAR PUMP OR MOTOR WITH A SHAFTLESS GEAR

[75] Inventor: Herbert J. Hauser, Jr., Waterloo, Iowa

[73] Assignee: Deere & Company, Moline, Ill.

[21] Appl. No.: 260,142

[22] Filed: May 4, 1981

[51] Int. Cl.[3] ..... F01C 1/20; F03C 2/08; F04C 2/20

[52] U.S. Cl. ..... 418/191; 418/196

[58] Field of Search ..... 418/190, 191, 196, 199, 418/200; 74/413, 414, 421 R, 460, 462

[56] References Cited

U.S. PATENT DOCUMENTS

| | | | |
|---|---|---|---|
| 137,056 | 3/1873 | Chapman | 418/191 |
| 2,626,570 | 1/1953 | Armington et al. | 418/191 |
| 2,699,122 | 1/1955 | Erickson | 410/196 |
| 2,760,381 | 8/1956 | Pickles | 74/460 |
| 3,120,190 | 2/1964 | Schmitter et al. | 418/191 |
| 3,286,643 | 11/1966 | Andrews et al. | 418/189 |
| 3,297,006 | 1/1967 | Marshall | 418/191 |

FOREIGN PATENT DOCUMENTS

| | | | |
|---|---|---|---|
| 2824762 | 12/1979 | Fed. Rep. of Germany | 418/191 |

*Primary Examiner*—John J. Vrablik

[57] ABSTRACT

In a gear pump or motor having a housing and at least two intermeshing gears, one of the gears being fixed to a rotatable shaft and the other being a shaftless gear having a plurality of gear teeth rotatable on a film of fluid in close proximity to an interior surface of the housing, the improvement being a unique tooth profile on the shaftless gear. Each gear tooth on the shaftless gear has a thick top land, preferably at least twice as thick as the top land on each gear tooth on the gear fixed to the rotatable shaft. This particular intermeshing gear tooth configuration increases the bearing surface of the shaftless gear on the film of fluid within the interior of the housing to better support the shaftless gear and thereby reduce frictional wear.

7 Claims, 3 Drawing Figures

GEAR PUMP OR MOTOR WITH A SHAFTLESS GEAR

BACKGROUND OF THE INVENTION

1. Field of the Invention

This invention relates to an improved gear pump or motor with a shaftless gear and more particularly to an improved gear pump or motor with a shaftless gear having a plurality of gear teeth with a unique tooth profile intermeshing with a gear fixed to a rotatable shaft.

2. Description of the Prior Art

Much effort has been spent in designing gear pumps or motors with a shaftless gear. Such pumps and motors reduce the assembly cost, eliminate some of the manufacturing problems associated with maintaining close tolerances between the gears and the interior of the housing, and of course they reduce the number of needed parts by eliminating at least one gear shaft and its corresponding bearings. Three such gear pumps or motors are described in the following U.S. Pat. Nos. 2,626,570, issued to Armington et al in January, 1953; 3,120,190, issued to Schmitter et al in February, 1964; and 3,286,643, issued to Andrews et al in November, 1966. The major problem with these kinds of pumps or motors is that the shaftless gear is inadequately supported within the housing and therefore tends to rub and wear against an interior surface of the housing. With increased wear, the shaftless gear moves further and further away from the fixed gear. This allows an increased volume of fluid to remain in the gear troughs of the intermeshing gears instead of being forced out of the pump or motor. After the efficiency of the pump or motor drops below a predetermined value, it has to be replaced. By reducing the wear of the gear teeth and the internal surface of the housing, the life of the pump or motor can be extended thereby necessitating less frequent replacement resulting in a cost savings to the owner.

Now an improvement for a gear pump or motor with a shaftless gear has been invented which increases its life expectancy by utilizing a shaftless gear having a unique tooth profile.

SUMMARY OF THE INVENTION

Briefly, this invention relates to an improved gear pump or motor having a housing with at least two intermeshing gears, one of the gears being fixed to a rotatable shaft while the other gear is a shaftless gear rotatable in close proximity to an interior surface of the housing. The improvement resides in the overall shape and size of the gear teeth on the shaftless gear. Each gear tooth on the shaftless gear has a thick top land, preferably at least twice as thick as the top land of each gear tooth on the gear fixed to the rotatable shaft. Furthermore, the combined thickness of all of the top lands on the gear teeth of the shaftless gear equal approximately 40 percent of the circumference of the shaftless gear. This particular tooth configuration increases the bearing surface of the shaftless gear on a film of fluid within the interior of the housing to better support the shaftless gear and thereby reduce frictional wear.

The general object of this invention is to provide an improved gear pump or motor having a shaftless gear which has a longer life expectancy because the frictional wear between the shaftless gear and the interior of the housing is reduced. A more specific object of this invnetion is to provide an improved gear pump or motor having a housing with at least two intermeshing gears, one gear being fixed to a rotatable shaft and the other being a shaftless gear having a plurality of gear teeth with thick top lands, the combined thickness of said top lands equaling approximately 40 percent of the circumference of the shaftless gear.

Another object of this invention is to provide an improved gear pump or motor with a shaftless gear wherein the profile of the gear teeth on the shaftless gear are configured to provide increase support to the shaftless gear approximately equivalent to the support provided by a standard size gear shaft.

Other objects and advantages of the present invention will become more apparent to those skilled in the art in view of the following description and the accompanying drawings.

DETAILED DESCRIPTION OF THE PREFERRED EMBODIMENT

Figure 1:
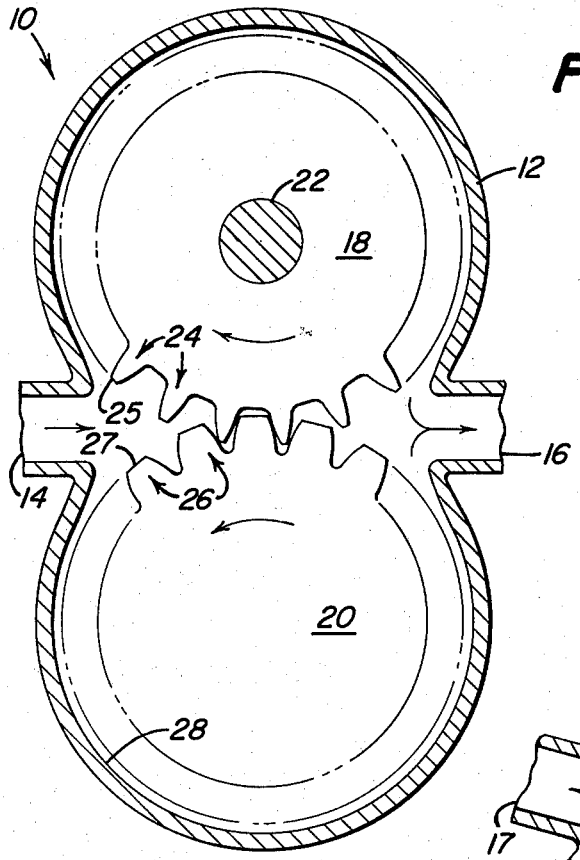
FIG. 1 is a cross-sectional view of an improved gear pump or motor having a housing with a pair of intermeshing gears, one gear being a shaftless gear having a plurality of gear teeth with a unique tooth profile for better supporting the shaftless gear within the housing.

Referring now to FIG. 1, a gear pump or motor 10 is shown having a housing 12 with an inlet port 14 and an outlet port 16. Within the housing 12 are two intermeshing gears, 18 and 20. The first gear 18 is fixed to a rotatable shaft 22 and has a plurality of involute gear teeth 24. Each gear tooth 24 has a top land 25 with a narrow thickness. The other gear 20 is a shaftless gear having a plurality of gear teeth 26, each gear tooth having a top land 27 which is preferably at least twice as thick as the top lands on the first gear 18. The shaftless gear 20, which preferably contains an involute gear tooth profile, intermeshes with the first gear 18 and is rotatable on a film of fluid in close proximity to an interior surface 28 of the housing 12. As the gears 18 and 20 intermesh, fluid is forced from the inlet port 14 around the periphery of the two gears 18 and 20 and from the housing 12 through the outlet port 16.

In a conventional gear pump arrangement, power is delivered through the rotatable shaft 22 making the gear 18 the drive gear and the gear 20 the driven gear. In a standard gear motor arrangement, the moving fluid acts as the driving force causing the two gears to rotate thereby turning the rotatable shaft 22 which in turn is used to operate another element, such as a drive belt.

Figure 2:
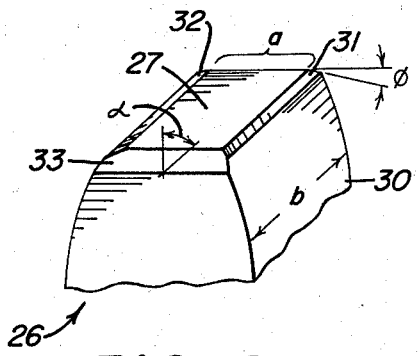
FIG. 2 is an enlarged perspective view of a single gear tooth having the improved profile with two chamfered edges and a chamfered end.

Turning now to FIG. 2, a single gear tooth 26 is shown having a thick top land 27, denoted as distance (a) and a normal face width 30, denoted as distance (b). The top land 27 is of such thickness that the total thickness of all of the top lands 27 on the gear teeth 26 of the shaftless gear 20 is approximately equal to between 30 and 50 percent of the circumference of the shaftless gear 20. Preferably, the total thickness of all of the top lands 27 is equal to approximately 40 percent of the circumference of the shaftless gear 20. This extra thickness on the top lands 27 enables the shaftless gear 20 to have a longer life expectancy because the frictional wear between the shaftless gear 20 and the interior surface 28 of the housing 12 is reduced. Furthermore, when the total thickness of the top lands 27 of the gear teeth 26 equal approximately 40 percent of the circumference of the shaftless gear 20, the shaftless gear 20 is supported by the gear teeth to about the same degree as if a standard size gear shaft were coaxially fixed through a central opening in the gear 20. By increasing the support to the shaftless gear 20, the frictional wear between the top lands 27 and the interior surface 28 of the housing 12 can be reduced thereby increasing the life of the gear pump or motor 10. With prolonged life, the need to replace the gear pump or motor 10 is substantially reduced thereby resulting in a cost savings to the owner.

In FIG. 2, two edge chamfers 31 and 32 are formed on opposite sides of the top land 27 and are aligned parallel to the central axis of the shaftless gear 20. The edge chamfers 31 and 32 are inclined at an angle ($\phi$) of between about 10 and 30 degrees as measured from the surface of the top land 27. These edge chamfers 31 and 32 assist in allowing a film of fluid to come between the top land 27 and the interior surface 28 of the housing 12 as the shaftless gear 20 is rotated therein. This feature of allowing the fluid to pass over each top land 27 decreases the frictional wear and aids in prolonging the life of the gear pump or motor 10. In addition to the edge chamfers 31 and 32, an end chamfer 33 is also present which is formed in the top land 27 perpendicular to the edge chamfers 31 and 32. The end chamfer 33 is inclined at an angle ($\alpha$) of between about 30 and 50 degrees as measured from the surface of the top land 27. This end chamfer 33 is beneficial in the assembly process, particularly when the shaftless gear 20 is placed into a circular bore or cavity which was machined into the housing 12. When forming such a bore, it is difficult to construct a sharp square corner between the cylindrical wall of the bore and the bottom of the bore. Usually a slight radius is left which prevents the shaftless gear 20 from seating flush against the bottom of the bore. The end chamfer 33 allows the shaftless gear 20 to be inserted fully into this bore and also allows the shaftless gear 20 to rotate more efficiently within the bore because virtually no fluid will be trapped between the bottom of the bore and the end of the shaftless gear 20. Without the presence of trapped fluid, the efficiency of the gear pump or motor 10 increases.

Figure 3:
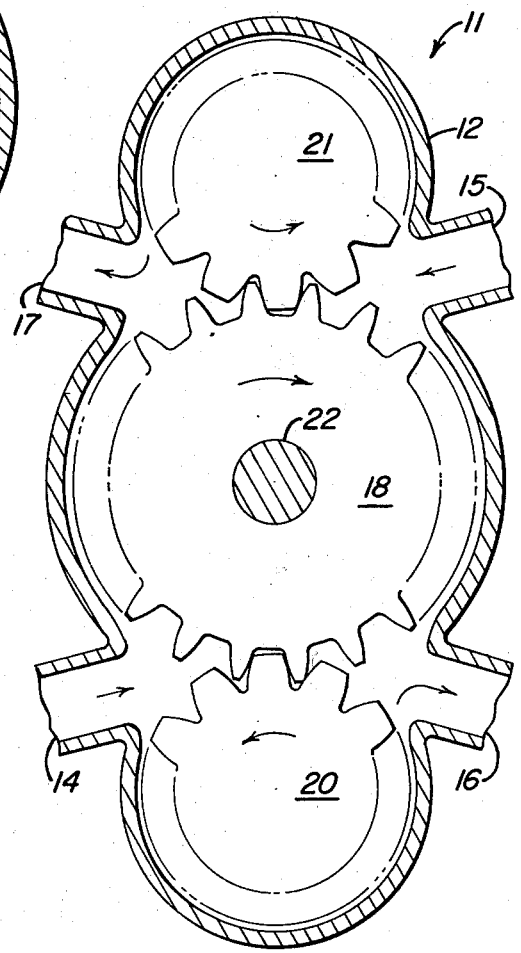
FIG. 3 is an alternative configuration to FIG. 1 showing two shaftless gears intermeshing with a gear fixed to a rotatable shaft.

Referring now to FIG. 3, an alternative configuration is shown for a gear pump or motor 11. In this embodiment, two shaftless gears 20 and 21 mesh with a single gear 18 which is fixed to a rotatable shaft 22. The presence of two intermeshing gear zones necessitates two inlet ports 14 and 15 and two outlet ports 16 and 17 to be formed in the housing 12. Such a gear pump or motor 11 would facilitate the movement of a fluid in two directions. Although, FIG. 3 specifically shows two shaftless gears intermeshing with a gear 18 mounted on a rotatable shaft 22, it is conceivable that a plurality of shaftless gears can be arranged to intermesh with a single fixed gear 18. Such arrangements are contemplated by this invention.

While the invention has been described in conjunction with two specific embodiments, it is to be understood that many alternatives, modifications and variations will be apparent to those skilled in the art in light of the aforegoing description. Accordingly, this invention is intended to embrace all such alternatives, modifications and variations which fall within the spirit and scope of the appended claims.

I claim:

1. In a gear pump or motor having a housing and at least two intermeshing gears, one of said gears fixed to a rotatable shaft and having a plurality of gear teeth and the other being a shaftless gear having a plurality of gear teeth rotatable on a film or fluid in close proximity to an interior surface of said housing, the improvement comprising top lands having a narrow thickness on said gear teeth of said gear fixed to said shaft and top lands having a wider thickness on said gear teeth of said shaftless gear for increasing the bearing surface of said shaftless gear on said film of fluid within said housing.

2. In a gear pump or motor having a housing and at least two intermeshing gears, one of said gears fixed to a rotatable shaft and having a plurality of gear teeth with top lands and the other being a shaftless gear having a plurality of gear teeth with top lands rotatable on a film of fluid in close proximity to an interior surface of said housing, the improvement comprising:

said top lands of said gear teeth on said shaftless gear having a combined thickness equal to between about 30 and 50 percent of the circumference of said shaftless gear and having a wider thickness than said top lands of said gear fixed to said rotatable shaft for providing a large bearing surface for said shaftless gear on said film of fluid within said housing.

3. An improvement according to claim 2 in which said combined thickness of all of the top lands of the gear teeth on said shaftless gear is approximately 40 percent of the circumference of said shaftless gear.

4. An improvement according to claim 2 in which the top lands of said gear teeth on said shaftless gear are at least twice as thick as the top lands of said gear teeth of said gear fixed to said rotatable shaft.

5. In a gear pump or motor having a housing enclosing at least two intermeshing gears, each gear having a plurality of gear teeth with an involute tooth profile and top lands, one of said gears being fixed to a rotatable shaft and the other being a shaftless gear rotatable on a film of fluid in close proximity to an interior surface of said housing, the improvement comprising: said top lands on the gear teeth of said shaftless gear being approximately twice as thick as the top lands on the gear teeth of said gear fixed to said rotatable shaft and further having edge chamfers of between about 10 and 30 degrees formed on each side of said top land of each gear tooth and aligned parallel to the central axis of said shaftless gear.

6. An improvement according to claim 5 in which each gear tooth on said shaftless gear contains an end chamfer of between about 30 and 50 degrees on each top land which is aligned perpendicular to said edge chamfers, all of said end chamfers being located on one side of said shaftless gear for facilitating assembly of said shaftless gear in an interior bore of said housing.

7. An improvement according to claim 6 in which two or more shaftless gears mesh with a gear fixed to a rotatable shaft.

* * * * *

UNITED STATES PATENT AND TRADEMARK OFFICE

CERTIFICATE OF CORRECTION

PATENT NO. : 4,386,893

DATED : 7 June 1983

INVENTOR(S) : Herbert J. Hauser, Jr.

It is certified that error appears in the above—identified patent and that said Letters Patent is hereby corrected as shown below:

Column 4, line 11, delete "or" and insert -- of --.

Signed and Sealed this

*Twenty-second* Day of *November 1983*

[SEAL]

*Attest:*

GERALD J. MOSSINGHOFF

*Attesting Officer*

*Commissioner of Patents and Trademarks*